United States Patent [19]

Iwaki et al.

[11] Patent Number: 4,958,823

[45] Date of Patent: Sep. 25, 1990

[54] PAPER FEEDING STAND

[75] Inventors: Hiroshi Iwaki, Ichinomiya; Yoshiharu Mita, Himeji; Jiro Miyazaki, Ogaki; Akihiko Suto, Anpachi; Satoshi Hirose, Anpachi; Tadashi Renbutsu, Anpachi, all of Japan

[73] Assignee: Sanyo Electric Co., Ltd., Osaka, Japan

[21] Appl. No.: 283,535

[22] Filed: Dec. 12, 1988

[30] Foreign Application Priority Data

Dec. 19, 1987 [JP] Japan ..... 62-322226
Dec. 19, 1987 [JP] Japan ..... 62-322227

[51] Int. Cl.[5] ..... B65H 3/06

[52] U.S. Cl. ..... 271/9; 271/110; 271/164; 271/263; 271/902

[58] Field of Search ..... 271/162, 164, 272, 273, 271/274, 111, 9, 263, 902

[56] References Cited

U.S. PATENT DOCUMENTS 3,961,786 6/1976 Yanker ..... 271/122
4,116,556 9/1978 Tanaka ..... 271/273 X
4,384,712 5/1983 Miyamoto ..... 271/273 X
4,436,406 3/1984 Murasaki ..... 271/9 X
4,583,844 4/1986 Honda ..... 271/4 X
4,605,215 8/1986 Hyltoft ..... 271/9
4,835,567 5/1989 Ogata ..... 271/164 X

FOREIGN PATENT DOCUMENTS 63-12350 4/1988 Japan .

*Primary Examiner*—Richard A. Schacher
*Attorney, Agent, or Firm*—Darby & Darby

[57] ABSTRACT

A paper feeding stand on which a recording apparatus such as a copying machine is mounted and which contains paper for recording and feeds the paper to the recording apparatus through intermediate rollers provided at the position opposing the paper entry of the recording apparatus according to the rotation of the intermediate rollers. When paper jam occurs between the intermediate rollers and the recording apparatus, the intermediate rollers are rotated in the reversal direction to return the paper to the intermediate roller section, and then the intermediate rollers are moved in the direction intersecting at right angles with the axial direction thereof to expose the intermediate rollers and the jammed paper to the outside so that the paper can be removed easily and surely without tearing.

18 Claims, 14 Drawing Sheets

PAPER FEEDING STAND

BACKGROUND OF THE INVENTION

1. Field of the Invention

The present invention relates to a paper feeding stand on which a recording apparatus such as a copying machine or the like is mounted and which is equipped with a paper feeding mechanism for feeding paper to the recording apparatus.

2. Description of the Prior Art

In one type of stand on which a copying machine is mounted, a paper feeding mechanism is provided as a supplemental feature for a copying machine, in addition to the paper feeding mechanism provided within the copying machine. Such a stand is so constructed that the paper is fed from the paper cassette installed in the stand to the paper entry provided at the bottom of the copying machine.

In such a stand, the paper is taken up one by one in a longitudinal direction from the horizontally mounted paper cassette by means of the take-up roller so provided as to press contact the paper. Then, the paper is transported vertically by way of a guide plate or the like toward the paper entry of the copying machine. The paper is then fed into the copying machine by means of a pair of intermediate rollers provided in the paper exit on the top of the stand at the position facing the paper entry of the copying machine till it stops at the pair of resist rollers located near the photosensitive drum.

The Japanese Patent Application Laid-Open No. 59-211060 discloses means for handling paper jam that occurs in such a stand as described above, by sliding the part including the paper cassette and the take-up roller out of the stand. In accordance with using this means, the paper jam in the paper cassette or near the take-up roller can be removed at the outside of the stand. However, when paper jam occurs in the path between the intermediate rollers and the resist rollers, it is not possible in many cases to remove the jammed paper because most of the paper is held inside the copying machine, leaving no portion to grip for removal.

Further, the Japanese Utility Model Application Laid-Open No. 62-71640 discloses a paper feeding stand in which a support member for accommodating a detachable paper cassette is installed in such a way that it is movable in longitudinal directions with respect to the stand so as to facilitate the handling in case of paper jam.

In the above mentioned paper feeding stand, a cylindrically shaped positioning pin extending in the longitudinal direction is provided in the stand. On the other hand, a U-shaped recess that engages with the above positioning pin is provided in the support member.

Accordingly, when the support member with a paper cassette being attached is inserted into the stand, the recess engages with the positioning pin to fix the support member into position in the stand.

In the prior art technique as mentioned above, the support member is fixed in position in the vertical and longitudinal directions when pushed into the stand, since the positioning pin is of cylindrical shape. However, since the support member is not fixed in the lateral directions, another means is required for positioning in the lateral directions.

Therefore, this prior art has a disadvantage that it requires a larger number of parts, leading to higher cost of parts and assembling.

The applicant of the present invention already proposed paper feeding stands that are disclosed in the Japanese Utility Model Application No. 62-116189 and the Japanese Utility Model Application Laid-Open No. 62-71640.

In the paper feeding mechanism described in the above Utility Model Application No. 62-116189, the paper feeding unit is adjustable only in the lateral directions. Therefore, to make it adjustable in the twisting directions as well as in the lateral directions, another adjusting plate is required between the fixed side and the bottom plate, as described in the Utility Model Application Laid-Open No. 62-71640.

As mentioned above, in accordance with the prior art by the applicant, in order that the paper feeding unit is adjustable in the lateral directions and also in the twisting directions, additional parts are required.

Therefore the prior art either causes the difficulty in adjustment or leads to cost increase.

Furthermore, as disclosed in the Japanese Patent Publication No. 55-24110, a paper feeding unit is proposed in which a pair of rollers, one being convex and the other concave, are installed and paper is transported, being buckled between the rollers. This paper feeding unit is not equipped with a paper guide.

Another type of paper feeding unit that transports paper in a buckled state is disclosed in the Japanese Patent Publication No. 62-29352. This paper feeding unit also is not equipped with a paper guide between the rollers.

In the above mentioned paper feeding units, paper may slant while being transported because a paper guide is not provided between the pair of rollers.

Further, since the paper is forcibly held in a buckled state by the pair of rollers, the paper remains warped in a slightly buckled state, and if it is transported to the image forming part in this state, the problem arises that the image is not precisely transferred to the paper.

Generally, since such paper feeding stands take the weight of copying machines, the weight causes stress to the stands, which may hamper proper operation of the paper feeding mechanism and result in failure of operation. Deformation of the stand can be prevented by using stronger structural members, but this will increase the weight of the stand and decrease the operatability, and therefore, not desirable.

SUMMARY OF THE INVENTION

This invention has been made to overcome the problems encountered in the above mentioned prior art. The first object of this invention is to provide a paper feeding stand which facilities the handling of paper jam caused at the intermediate rollers by making the intermediate rollers that feed paper to the copying machine movable in the directions intersecting the longitudinal directions of the rollers' axes.

The second object of this invention is to provide a paper feeding stand which facilitates the handling of paper jam caused in the path between the intermediate rollers and the copying machine by providing means for reversing the intermediate rollers.

The third object of this invention is to provide a paper feeding stand in which the first paper feeding mechanism having intermediate rollers and movable in the directions intersecting the longitudinal directions of the rollers' axes and the second paper feeding mechanism movable in the directions intersecting the intermediate rollers are provided, thereby further facilitating the handling of paper jam caused in these sections.

The fourth object of this invention is to provide a paper feeding stand which does not damage the paper when the paper jam occurs in the second paper feeding mechanism by making the above mentioned second paper feeding mechanism movable only after the above mentioned first paper feeding mechanism has been moved.

The fifth object of this invention is to provide a paper feeding stand which realizes reduction in cost of parts and assembling by positioning the support member in the longitudinal, lateral and vertical directions by using a single pin.

The sixth object of this invention is to provide a paper feeding stand which is adjustable in the twisting directions as well as the lateral directions by improving the mounting construction of the paper feeding mechanism while minimizing cost increase.

The seventh object of this invention is to provide a paper feeding stand which can feed paper without causing slanting or deformation of the paper by providing a guide roller to guide the paper between the intermediate rollers having a plurality of rollers on a pair of axes.

The eighth object of this invention is to provide a paper feeding stand which realizes reduction in weight by improving the frame construction.

The above and further objects and features of the invention will more fully be apparent from the following detailed description with accompanying drawings.

DESCRIPTION OF THE PREFERRED EMBODIMENTS

Figure 1:
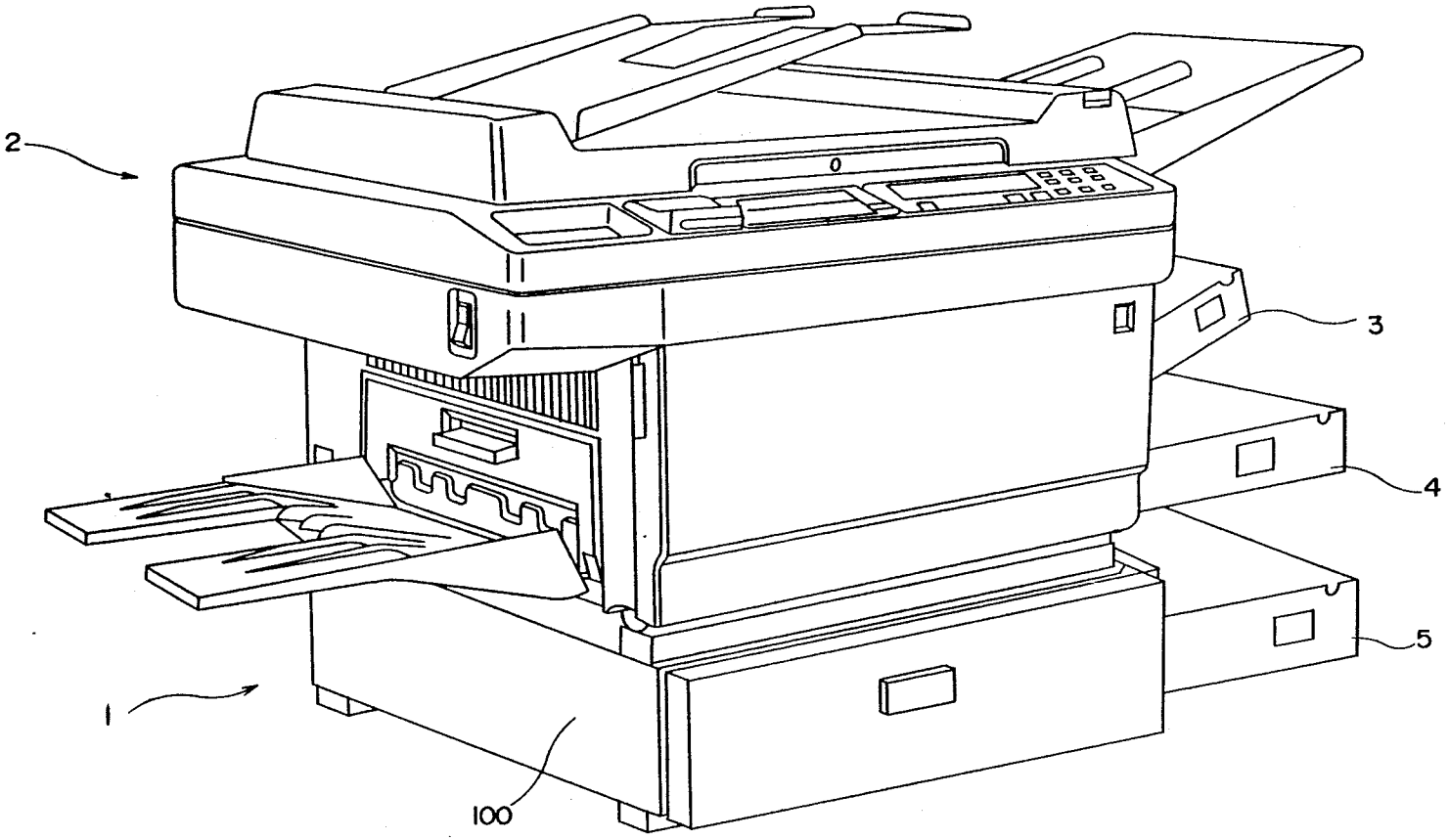
FIG. 1 is a left side appearance perspective view showing the apparatus of the present invention in an installed condition to a copying machine.
Figure 2:
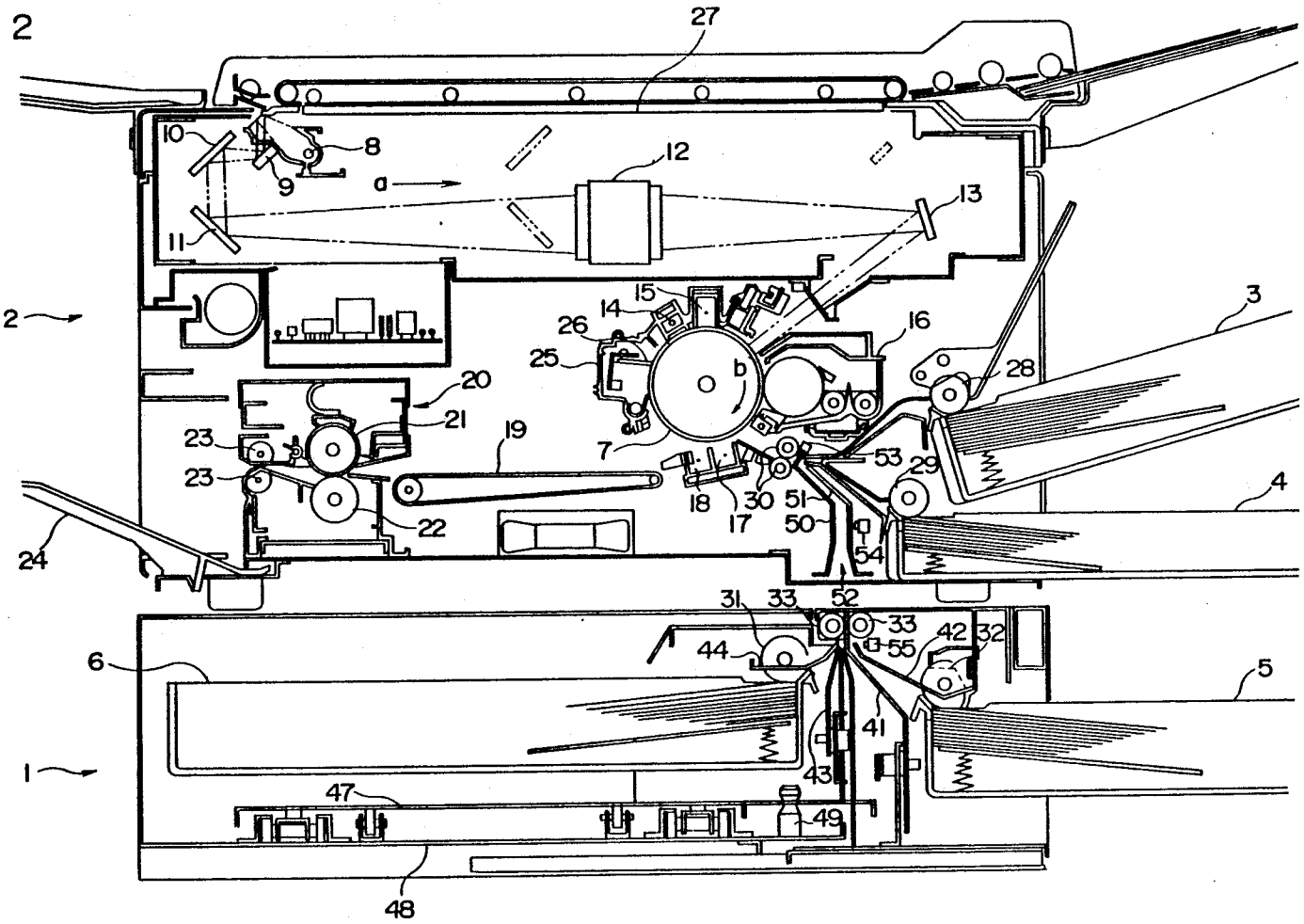
FIG. 2 is a rough sectional elevation showing the internal construction of the apparatus of the present invention in an installed condition to a copying machine.

The present invention will be described in a concrete form below based on the drawings showing the embodiments of the invention. FIG. 1 is a left side appearance perspective view showing the apparatus of the present invention in an installed condition to a copying machine. FIG. 2 is a rough sectional elevation showing the internal construction of the apparatus of the present invention in an installed condition to a copying machine. The copying machine 2 which is a recording apparatus mounted on the paper feeding stand 2 operates in such a way that an original placed on the platen glass 27 constituting the original table is exposed by an exposure lamp 8. The image to be developed is scanned by the first scanning mirror 9 integrally constructed with the exposure lamp 8 and by the second and third mirrors 10 and 11 which move with the first mirror 9 in the direction of the arrow "a", that is, to the right of the copying machine 2. The scanning light reaches, via the lens 12 and the fourth mirror 13, the surface of the photosensitive drum 7 being rotated in the direction of the arrow "b" by the main motor that is not shown in the drawing. The photosensitive drum 7 which is discharged in advance by the discharge lamp 14 is charged uniformly by the charging unit 15 located in the rotating direction of the photosensitive drum 7, and an electrostatic latent image is formed when the above mentioned image exposure is performed.

Then, the electrostatic latent image is developed by the developing unit 16 located next to the charging unit 15 in the rotating direction of the photosensitive drum 7, and a visible image is formed with the toner. Paper is fed by a pair of resist rollers 30 located next to the developing unit 16 in the rotating direction of the photosensitive drum 7. The toner image is transferred to the paper by the transfer unit 17 located under the photosensitive drum 7, that is, next to the resist rollers 30 in the rotating direction of the photosensitive drum 7.

A separator 18 is provided at the position next to the transfer unit 17 in the rotating direction of the photosensitive drum 7. The paper on which the toner image has been transferred is separated by the separator from the photosensitive drum 7 and transported by the transporting belt 19 to the fixing unit 20. A cleaning unit 25 is provided at the position next to the separator 18 in the rotating direction of the photosensitive drum 7, which removes and cleans residual toner on the photosensitive drum 7 by the cleaning blade 26.

The toner image is melted and fixed on the paper, transported to the fixing unit 20, by a pair of rollers, one being the heat roller 21 and the other the press roller 22, and then the paper is carried out by a pair of paper discharge rollers 23 to the receiver tray 24.

On the right side of the copying machine 2, detachable paper cassettes 3 and 4 are installed. The paper loaded in each cassette is fed either by the take-up roller 28 or 29 and stops at the resist rollers 30. As previously described, the paper is then fed into the clearance between the photosensitive drum 7 and the transfer unit 17 by the resist rollers driven in synchronization with the leading edge of the toner image formed on the photosensitive drum 7. Separately from the paper feeding paths leading from the above mentioned cassettes 3 and 4 to the resist rollers 30, another paper feeding path is formed at the bottom of the copying machine 2, which is constructed of the paper guide plates 50 and 51 standing from both sides of the paper entry 52. At the end of these paper feeding paths, that is, at the position immediately before the resist rollers 30, and at the middle point of the paper feeding path comprising the paper guides 50 and 51 leading from the above mentioned paper entry 52, sensors 53 and 54, e.g. photoelectric type, are provided to detect the paper being transported.

Figure 3:
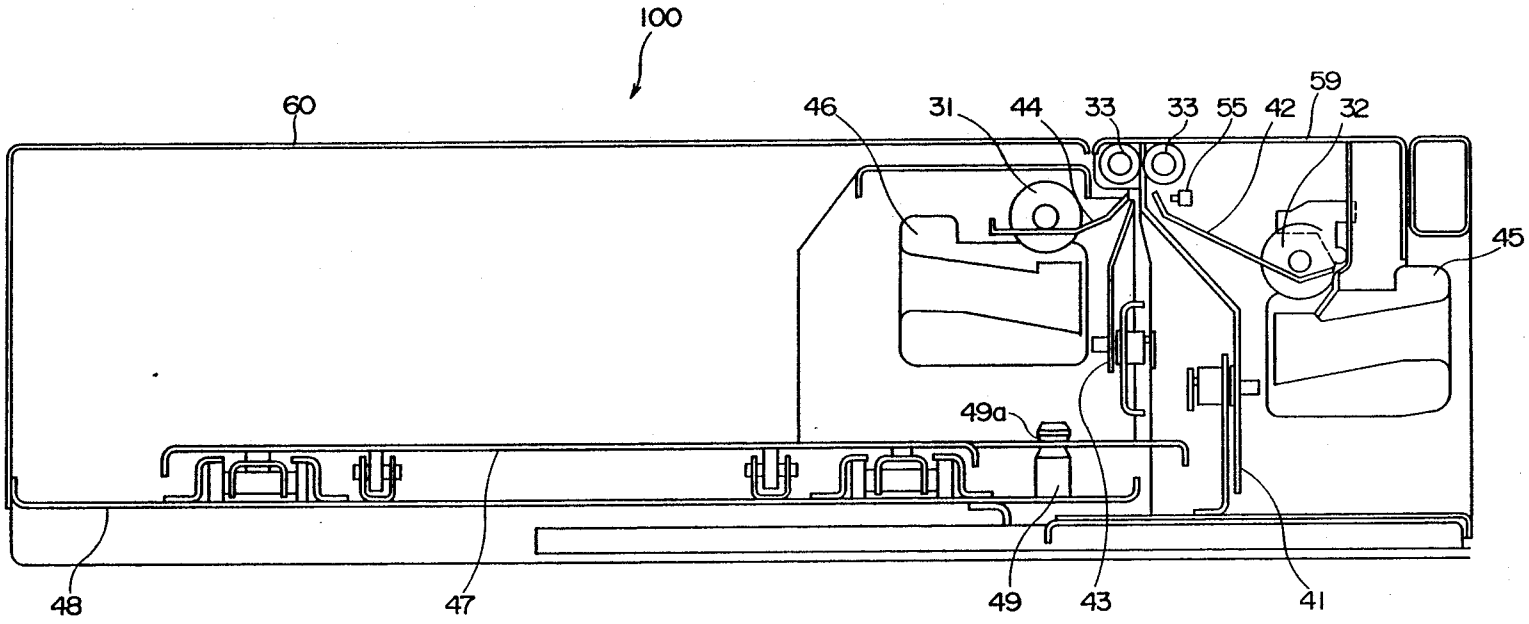
FIG. 3 is a sectional elevation of the apparatus of the present invention.
Figure 4:
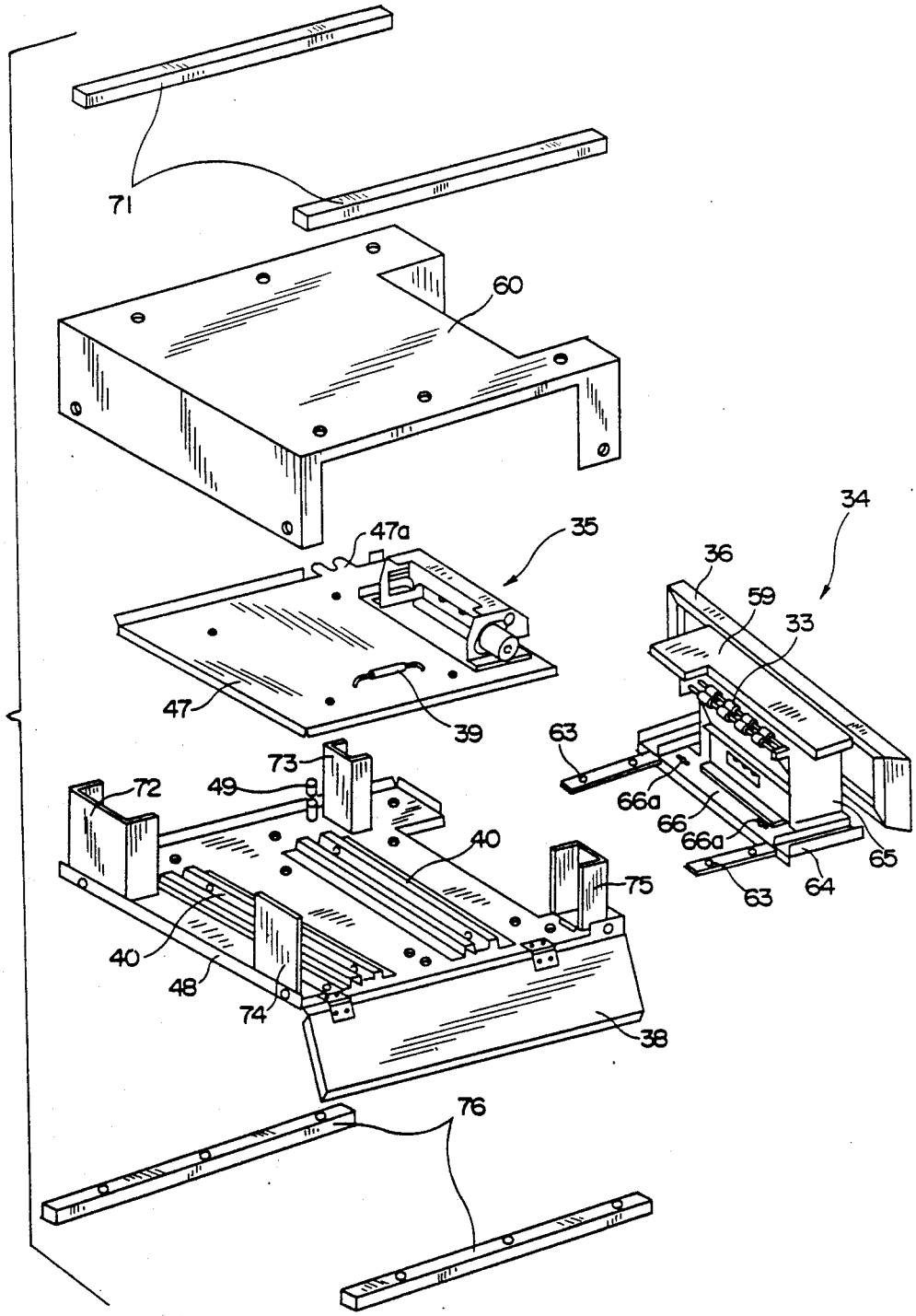
FIG. 4 is a left side exploded perspective view showing the construction of the apparatus.
Figure 5:
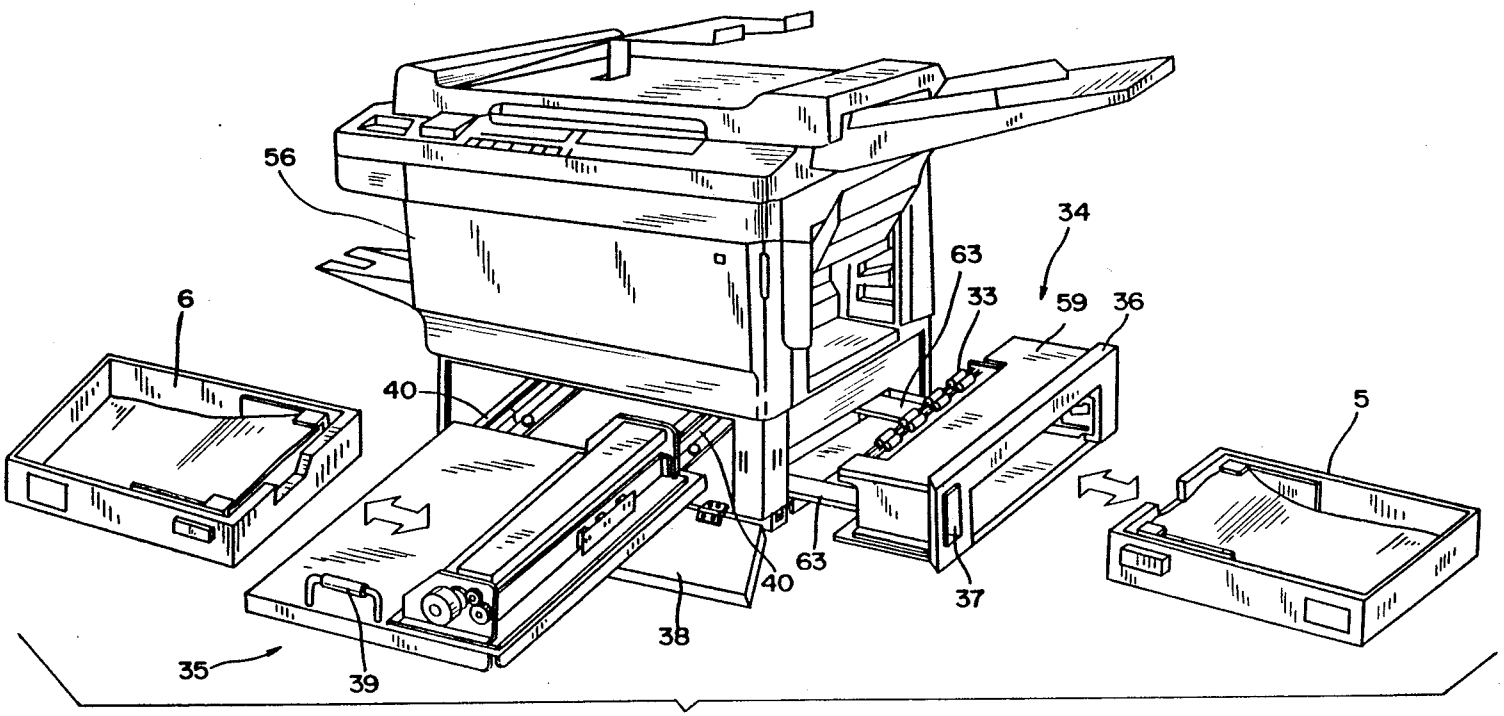
FIG. 5 is a right side appearance perspective view showing the apparatus in an open condition.

FIG. 3 is a sectional elevation of the paper feeding stand. FIG. 4 is a left side exploded perspective view showing its construction. FIG. 5 is a right side appearance perspective view showing the stand in an open condition. The paper stand 1 has a rectangular parallelepiped main frame 100 having a top of the approximately same size as the bottom of the copying machine 2. As shown in FIG. 4, the main frame 100 is provided with columns 72, 73, 74 and 75 in the corners by which to support the top cover 60 having side walls.

On the front and rear sides of the top cover 60, square pillar-shaped support rods 71 and 71 having the same length as that of the right and left sides of the main frame 100 are provided, on which the copying machine 2 is to be mounted. On the back of the bottom plate 48, support rods 76 and 76 similar to the above mentioned support rods 71 and 71 are provided at the positions opposed to the support rods 71 and 71 across the main frame 100. This means that the load of the copying machine 2 received by the upper support rods 71 and 71 is transferred via the columns 72, 73, 74 and 75 to the lower support rods 76 and 76.

The above mentioned paper feeding main frame 100 is equipped with two paper feeding mechanisms, one of which is the mechanism for the right side cassette part 34 which is installed on the right side of the main frame 100 with a portion of the paper cassette 5 protruding outside the main frame 100 as in the case of the copying machine 2. The right side cassette part 34 has a side wall 36 which is provided with an opening for loading of the paper cassette 5 and which also constitutes the detachable right side wall of the main frame 100, and is so constructed that the right side cassette part 34 can be drawn out to the right of the main frame 100 by work of the sliding blocks 63 and 63 provided at the lower part of the right side cassette part 34 and sliding along the back of the bottom plate 48. A handle 37 is provided at one end of the side wall 36 on the front of the main frame 100 to slide out the right side cassette part. The other paper feeding mechanism is the left side cassette part 35 that accommodates the paper cassette 6 inside the main frame 100. The left side cassette part 35 has at its bottom a support plate 47 which has a size smaller than the above mentioned bottom plate 48. Between the lower surface of the support plate 47 and the upper surface of the bottom plate 48, sliding blocks 40 and 40 are provided, which slide along the lower surface of the support plate 47, so that the support plate 47 or the left side cassette part 35 can be drawn out to the front side when the front cover 38 of the main frame 100 is left open to the front side. A handle 39 is provided at the front edge on the upper surface of the support plate 47 to slide out the left side cassette part. Since the whole part of the left side cassette part 35 including the paper cassette 6 can be housed inside the main frame 100, the left side cassette part 35 does not restrict the work space around the machine.

Figure 6:
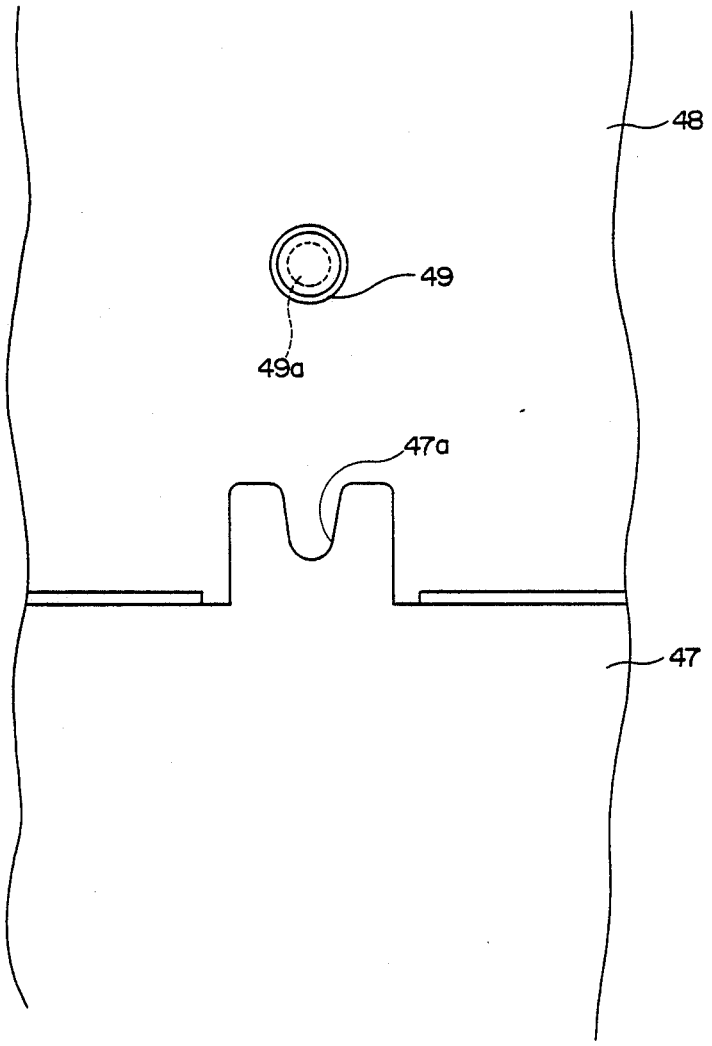
FIG. 6 and FIG. 7 are a partial plan view and a partial front view respectively, showing the relationship of the support plate to the bottom plate.
Figure 7:
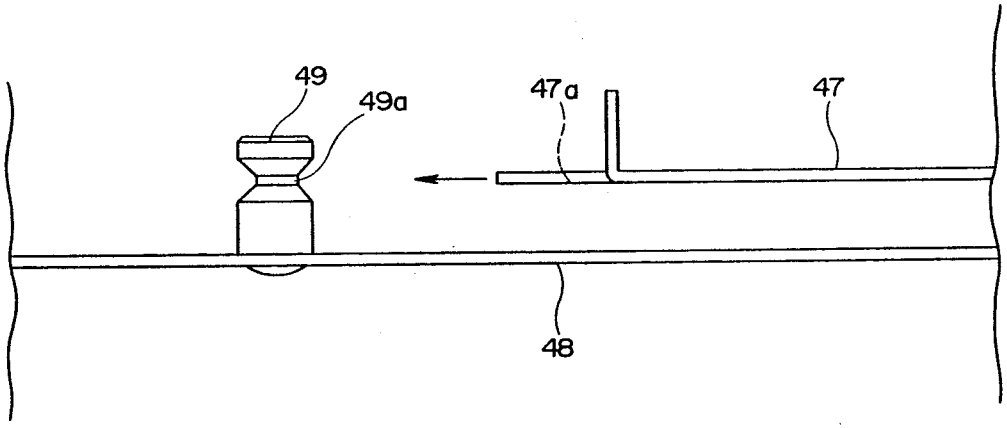

FIG. 6 and FIG. 7 are a partial plan view and a partial front view respectively, showing the relationship of the support plate to the bottom plate. As shown in these drawings, a U-shaped notch 47*a* is provided at the end of the back surface of the support plate 47. The U-shaped notch 47*a* engages with the pin 49 provided on the bottom plate 48 when the support plate 47 is inserted in the main frame 100, thereby fixing the left side cassette part 35 in loading position. The pin 49 in its middle is narrowed in diameter, in the state of being tapered from its tip and base side so that the narrowed portion engages with the notch 47*a*. This means that, if the support plate 47 is inserted slightly off center in the vertical directions, the notch 47*a* slides along the sloped surface of the pin 49 to engage with the narrowed portion, thus fixing the support plate 47 in position in the vertical, lateral and longitudinal directions. The right side cassette part 34 is integrally constructed with the right side wall of the main frame 100, which makes it easy to fix the cassette part 34 in position when inserted. However, the same construction as that for the left side cassette part 35 may be adopted as for the right side cassette part 34.

As shown in FIG. 3, each of these cassette parts is so constructed that it can accommodate and feed paper from the paper cassettes used in common with the copying machine 2 by using the cassette guides 45 and 46 so provided as to hold the ends of the cassettes. Each cassette part is provided with a take-up roller and paper guides. In the right side cassette part 34, the take-up roller 32 and the paper guides 41 and 42 are provided near the left edge of the cassette 5 inserted in the cassette part 34. On their opposing side near the right edge of the cassette 6 inserted in the left side cassette part 35, the take-up roller 31 and the paper guides 43 and 44 are provided. The rotating axis of each of the take-up rollers 31 and 32 is positioned parallel with the rotating axes of the previously mentioned resist rollers. The paper guides extend upward between the paper cassettes 5 and 6, coming closer to each other as they approach the position where a pair of intermediate rollers 33 are provided in the right side cassette 34 with their rotating axes positioned parallel with those of the take-up rollers 31 and 32. Under the intermediate roller 33 which is the roller nearer to the cassette 5, a sensor 55 similar to the previously mentioned sensor 53 is provided.

Figure 8:
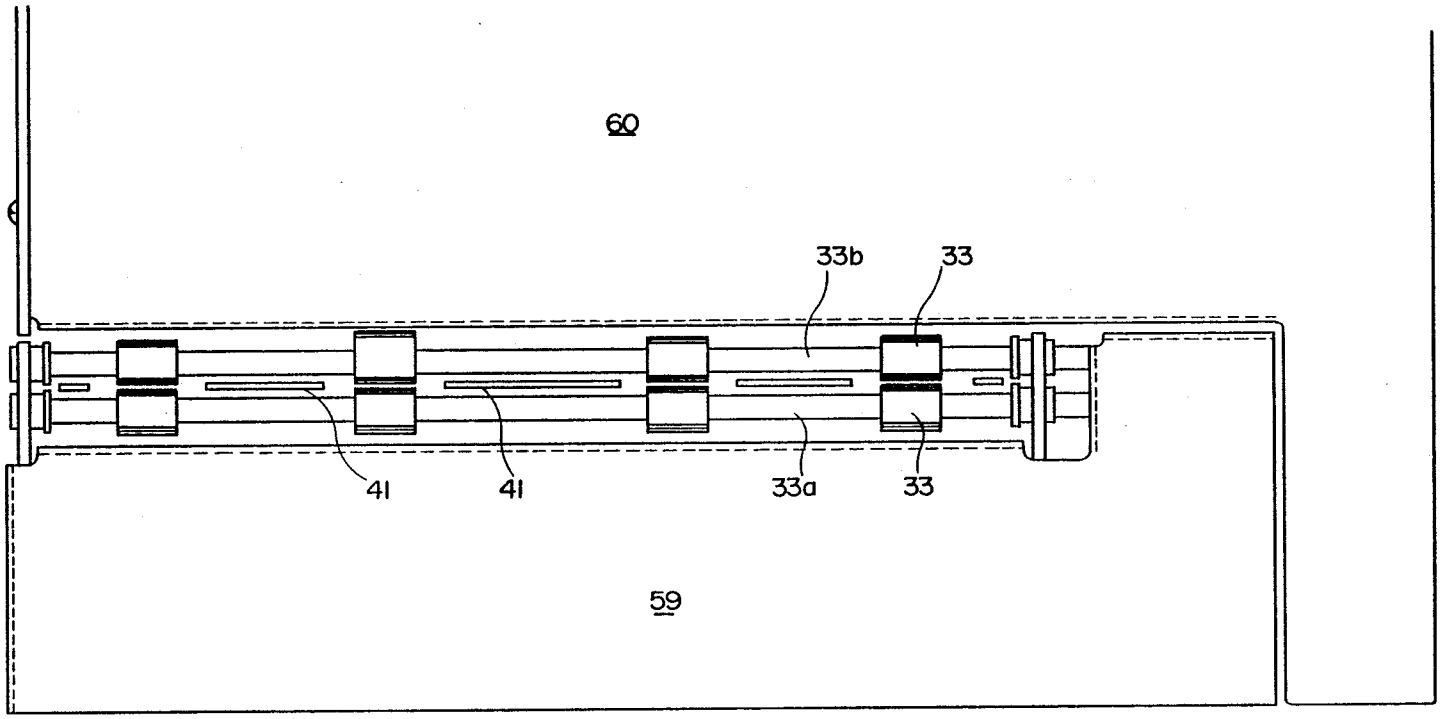
FIG. 8 is a plan view of the portions adjacent to the intermediate rollers located in the middle of the stand.

FIG. 8 is a plan view of the portions adjacent to the intermediate rollers 33 located at the top of the main frame 100. A rectangular notch is provided in the right edge of the top cover 60 of the main frame 100. It is so constructed that the top of the right side cassette part 34 engages with this notch. The intermediate rollers provided in an exposed condition on the left side of the right side cassette part 34 (on the upper side in FIG. 8) are so positioned that the upper surfaces of the intermediate rollers 33 come approximately flush with the upper cover 59 of the right side cassette part 34. These are also positioned approximately flush with the upper cover 60 of the main frame 100. The intermediate rollers 33 comprise of a pair of a plural rollers, each set of rollers being arranged on each of the rotation shafts 33*a* and 33*b* with a proper spacing between the rollers. The previously mentioned paper guide 41 provided at the center side of the main frame 100 in the right side cassette part 34 extends between the the rotation shafts 33*a* and 33*b*, keeping parallel with the shafts 33*a* and 33*b*, with its upper end having a plurality of notches to prevent contact with the rollers and with the center of its thickness positioned on the center between the rotation shafts 33*a* and 33*b*. The upper end of the paper guide 41 is positioned approximately flush with the upper surface of the intermediate rollers 33. The intermediate rollers 33 are provided at the position opposing and directly under the previously mentioned paper entry 52 in the bottom of the copying machine 2.

Figure 9:
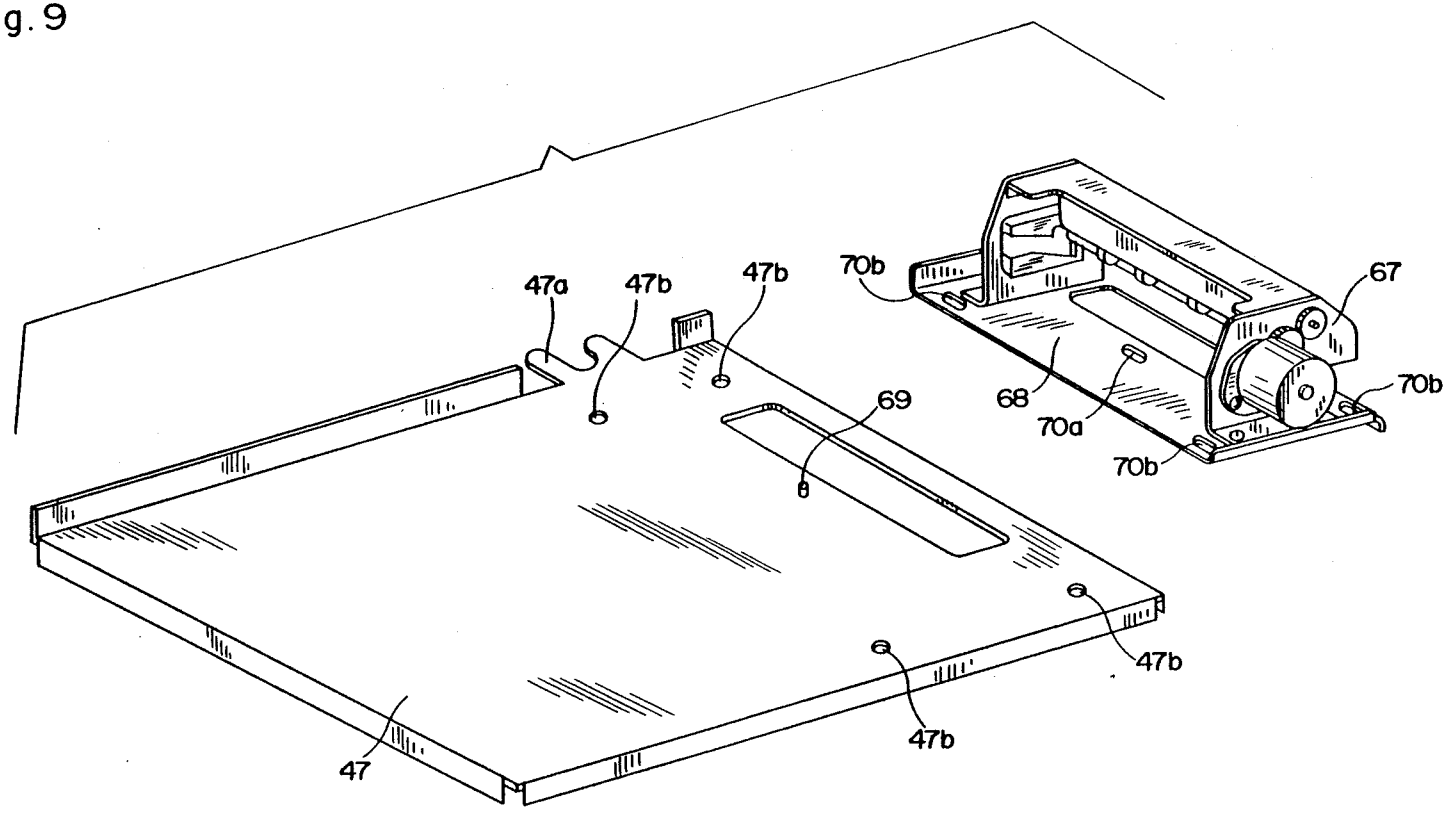
FIG. 9 is a left side appearance perspective view showing the construction of the left side cassette.

The paper delivered from the right or left cassette part must be transported to the correct position on the photosensitive drum 7 without deviating in lateral directions. For this purpose, the mounting position of the paper feeding mechanism of each cassette part is adjusted in the following manner with respect to the axial directions of the paper feeding rollers. Regarding the right side cassette part 34, the adjustment is made in such a way that as shown in FIG. 4, when screwing the bottom plate 66 of the chassis 65 having the above mentioned intermediate rollers 33 and the take-up roller 32 to the support plate 64 on which the sliding part 63 are fixed, the bottom plate 66 can be fixed in position after adjusting the mounting position in the axial direction of the rollers by means of the oval holes 66*a* having a width for adjustment of each rollers in the axial direction. Regarding the left side cassette part 35, the mounting position must be adjusted with respect to the parallelism to the intermediate rollers 33 of the right side cassette part 34 in addition to the adjustment in the axial direction of the photosensitive drum 7. FIG. 9 is a left side appearance perspective view of the chassis 67 having the take-up roller 31, etc. of the left side cassette part 35 and its support plate 47. At four corners of the bottom plate 68 on which the chassis 67 is fixed, oval holes 70*b* having widths for adjustment respectively in the axial direction of the take-up roller 31 and in the direction intersecting at right angles therewith are provided. Further, an oval hole 70*a* having a width for adjustment in the axial direction of the take-up roller 31 is provided in the center. The bottom plate 68 having the chassis 67 is screwed on the right side of the support plate 47 using the above mentioned oval holes 70*b*. On the right side of the support plate 47, four screw holes 47*b* are provided at the positions corresponding to the centers of the oval holes 70*b*. At the position equally spaced from these screw holes 47*b*, a protruding pin 69 is provided which fits in the above mentioned oval hole 70*a*. The diameter of this pin 69 is approximately equal to the width of the oval hole 70*a* measured in the direction that intersects at right angles with the axial direction of the take-up roller 31. To adjust the position for mounting the bottom plate 68 to the support plate 47, the bottom plate 68 is first screwed tentatively to the support plate 47 using the oval holes 70*b* and the screw holes 47*b*. Then, the copying machine 2 is operated for copying. If the paper is delivered from the left side cassette part 35 without deviation with respect to the axial direction of the photosensitive drum 7, the step proceeds to the adjustment with respect to the parallelism to the intermediate rollers 33. If any deviation is recognized, the screws are loosened to move the bottom plate 68 along the oval holes 70*b* in the axial direction of the photosensitive drum 7 to adjust its position. To adjust the parallelism to the intermediate rollers 33, the screws are loosened, and the bottom plate 68 is rotated around the above mentioned pin 69 fitted in the oval hole 70*a* to determine the position where the parallelism to the intermediate rollers 33 is obtained. As mentioned above, the diameter of the pin 69 is approximately equal to the width of the oval hole 70*a* measured in the direction that intersects at right angles with the axial direction of the take-up roller 31, thus making it possible to adjust only the parallelism to the intermediate rollers 33 without causing the bottom plate 68 or the paper feeding mechanism to slide off the position in the direction intersecting at right angles with the axial direction of the take-up roller 31.

In the paper feeding stand 1 thus constructed, the selection of the paper cassette to be used is made on the side of the copying machine 2. When the cassette 5 is selected, the paper loaded in the cassette 5 is taken up by the work of the take-up roller 32 driven from the start of the copying operation, to be transported between the paper guides 41 and 42. When the cassette 6 is selected, paper is transported between the paper guides 43 and 44 in the same manner as above by the work of the take-up roller 31. The paper delivered from either one of the cassettes reaches the intermediate rollers 33 which are being rotated in such directions as to feed the paper to the copying machine 2.

The paper that passes through the intermediate rollers 33 is buckled in the direction intersecting at right angles with its path by the work of the previously described paper guide 41 whose upper part is positioned between the rotation shafts 33*a* and 33*b* of the pair of intermediate rollers 33. Thus the paper being transported to the copying machine 2 is given enough resilience to reach the resist rollers 30. The paper transported to the resist rollers 30 is further transported to contact the surface of the photosensitive drum 7 where the toner image is transferred to the paper.

If the paper stops in the path between the intermediate rollers 33 and the resist rollers 30, that is, in case of paper jam, the previously mentioned sensors 53, 54 and 55 work to check the presence of the paper in the respective sensing sections. If only the sensor 53 detects the paper, this means that the paper is already discharged from the intermediate rollers 33 and that the paper is held by the resist rollers 30, and the copying machine 2 is made to display that the paper jam has occurred near the resist rollers 30.

On the other hand, if the sensors 53 and 54 or all sensors or the sensors 54 and 55 detect the paper, the intermediate rollers 33 are made to rotate in the reversal direction to return the jammed paper from the copying machine 2 to the paper feeding stand 1. The reversal operation may be controlled in terms of time or distance. After the intermediate rollers 33 have been rotated in the reversal direction, all sensors are put into work once again to check the presence of the paper. If the sensor 53 detects the paper, this means that the paper is held by the resist rollers 30 and could not be removed by reversal rotation of the intermediate rollers 33, and the copying machine 2 is made to display that the paper jam occurred near the resist rollers 30. In accordance with this display, the operator draws out and opens the front cover 56 of the copying machine 2 and rotate the resist rollers 30 to remove the jammed paper.

Figure 10:
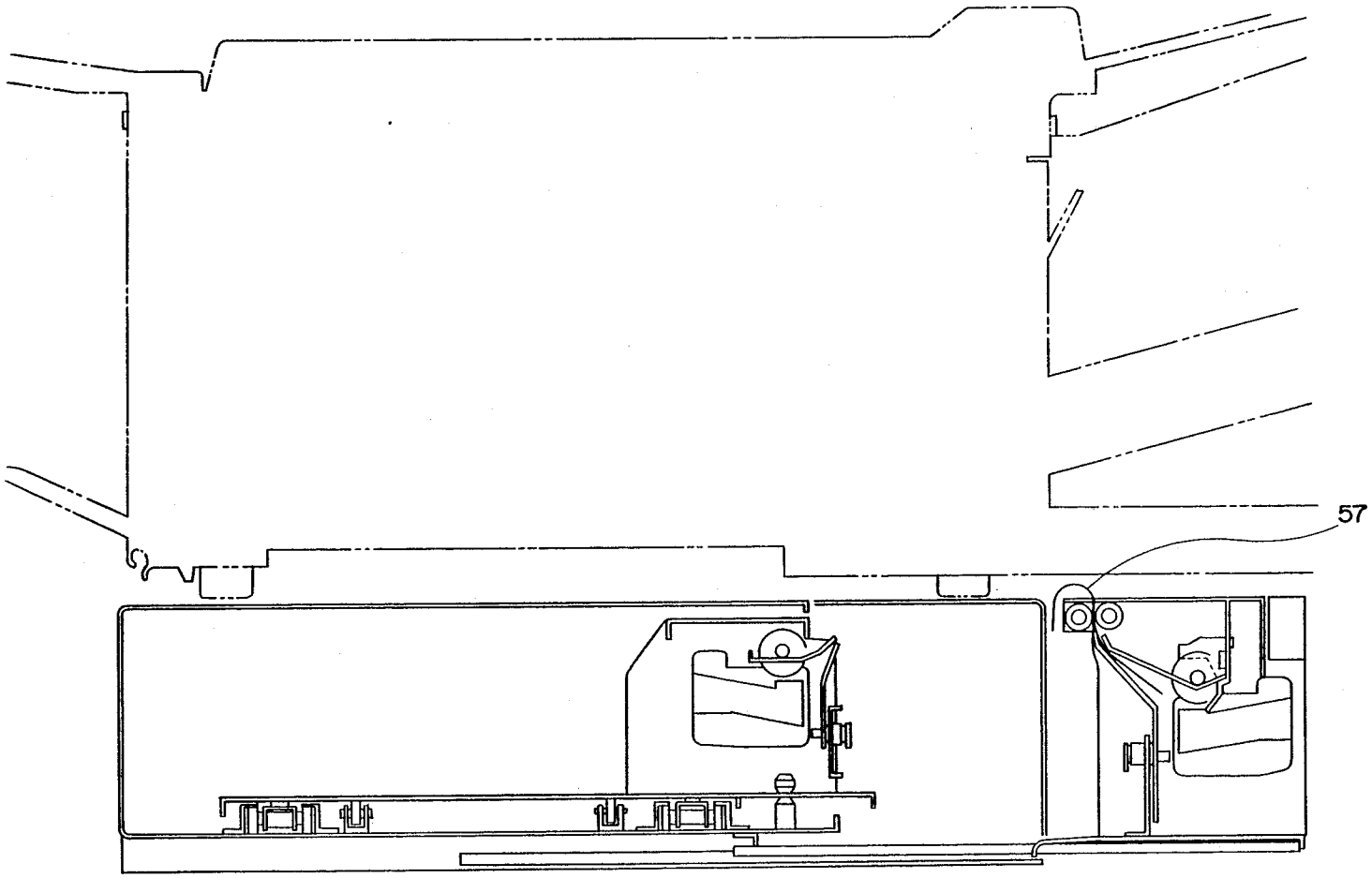
FIG. 10 and FIG. 11 are sectional elevations showing the right side cassette in a drawn out condition.
Figure 11:
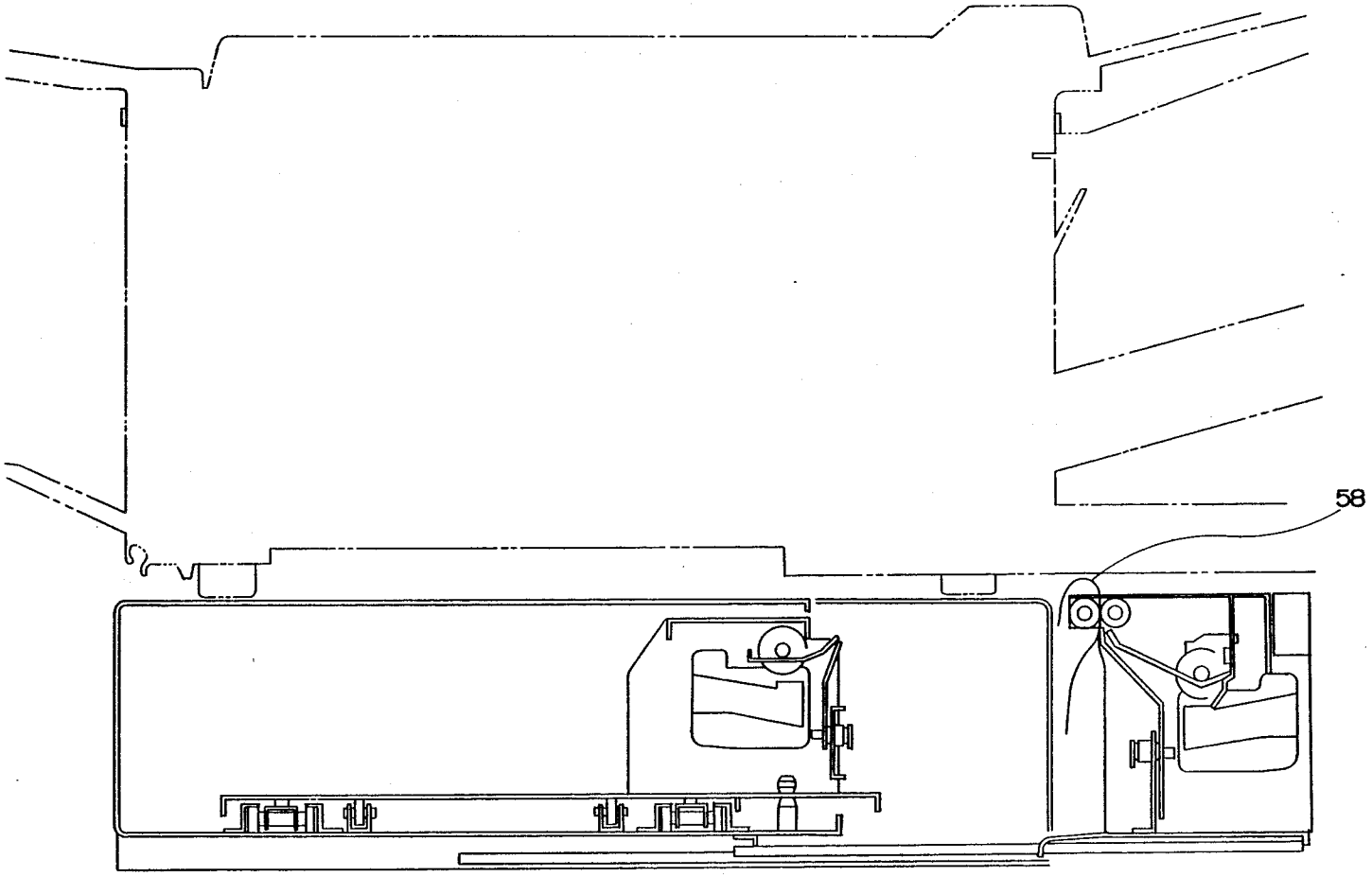

On the contrary, if the sensor 53 does not detect the paper, this means that the paper is not held by the resist rollers 30 but by the intermediate rollers 33, and the copying machine 2 is made to display the instruction that the right side cassette part 34 be drawn out of the stand. FIG. 10 and FIG. 11 are sectional elevations showing the right side cassette 34 in a drawn out condition. The paper 57 shown in FIG. 10 is delivered from the right side cassette part 34, and the paper 58 in FIG. 11 from the left side cassette part 35. As shown, the intermediate rollers 33 are provided in the right side cassette part 34. Therefore, by drawing out the right side cassette part 34, the paper comes exposed to the outside of the main frame 100 and can be removed. The paper 58 delivered from the left side cassette part 35 can also be easily removed from the intermediate rollers 33 as in the case of the paper 57 delivered from the right side cassette part 34, because it is held by the intermediate rollers 33. Further, since the upper cover 59 of the right side cassette part 34 is of separate construction from the upper cover 60 of the main frame 100 as previously mentioned, a space is created under the paper entry 52 of the copying machine 2 when the right side cassette part 34 is drawn out, which makes it possible to easily remove the paper from the right side of the main frame 100 as shown in FIG. 5 even if the paper is not held by the intermediate rollers 33 but in the paper entry 52. Furthermore, the upper cover 59 of the right side cassette part 34 serves to protect the parts of the take-up roller 32 from being exposed to outside when the right side cassette 34 is drawn out.

Figure 12:
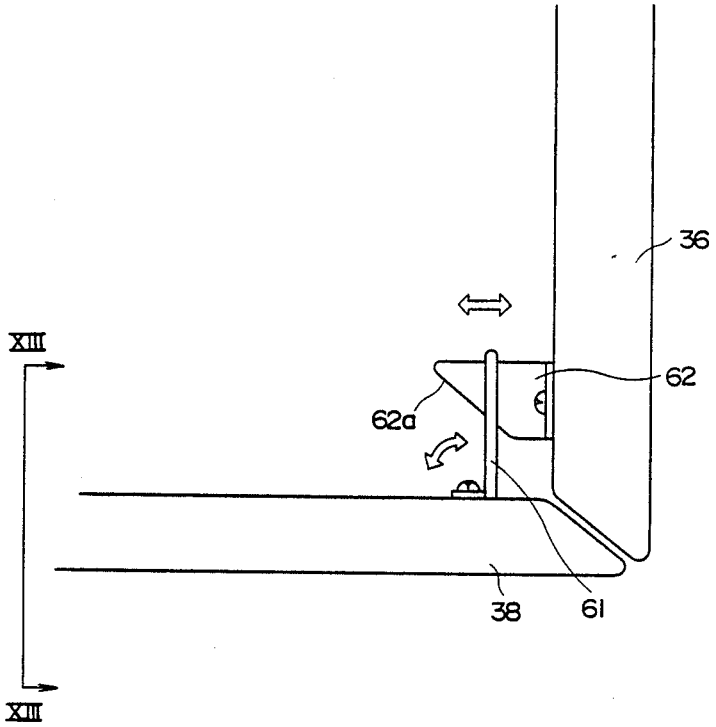
FIG. 12 is a plan view of the main portion of the opening mechanism.
Figure 13:
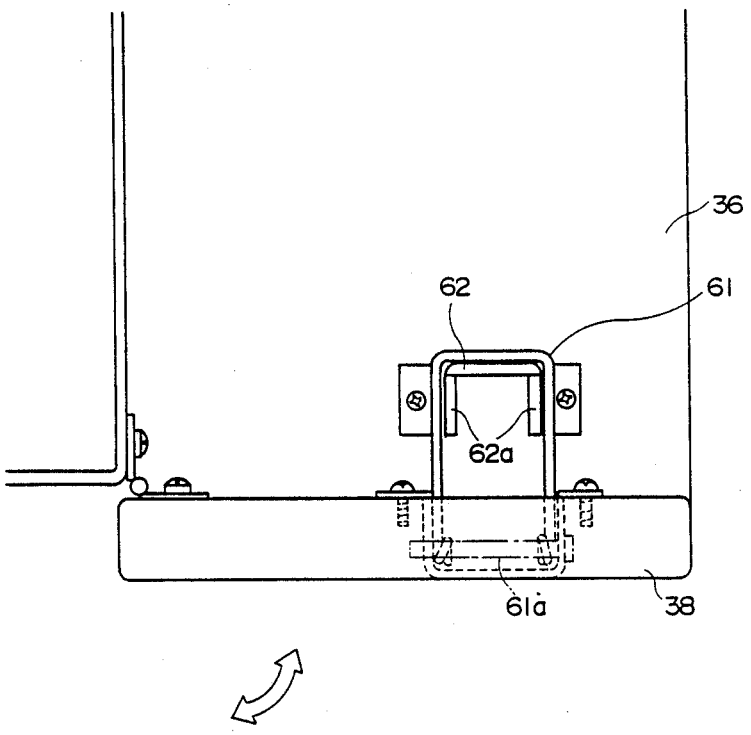
FIG. 13 is a fragmentary view taken along the line XIII —XIII of FIG. 12.

Paper is thus removed in case of paper jam after the the right side cassette part 34 has been drawn out as described above. If the paper delivered from the left side cassette part 35 has jammed, and if the left side cassette part 35 is drawn out first after the intermediate rollers 33 have been rotated in the reversal direction, the paper will be torn because the paper with one end in the copying machine 2 and the other end inside the left side cassette part 35 is drawn in the direction intersecting at right angles with the direction of the paper path. To prevent this, the mechanism shown in FIG. 12 is provided. FIG. 12 is a plan view showing the mounting condition of the hook 61 and the protrusion 62 provided near the ends of the front cover 38 of the main frame 100 and the side wall 36 of the right side cassette part 34. FIG. 13 is a fragmentary view taken along the line XIII—XIII of FIG. 12. The hook 61 is C-shaped, the left end of which is wound on the shaft **61*a* provided on the back of the front cover 38 in the shape of a spring, with the longer side of the shape C placed flush with the surface of the front cover 38. It is so constructed that the tension caused by the above design works to keep the opened sides of the shape C standing approximately perpendicular to the back of the front cover 38. The protrusion 62 provided on the back of the side wall 36 has a rectangular part which engage with the inside of the shape C. Its end is cut off to form a slope 62*a* on the side facing the front cover 38**.

Figure 14:
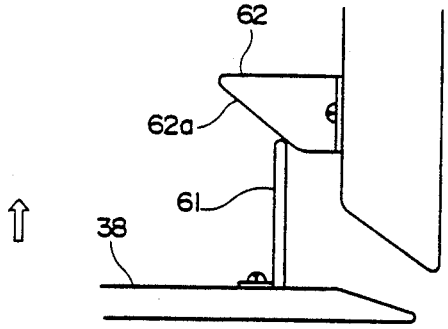
FIGS. 14(*a*), 14(*b*) and 14(*c*) are diagrams illustrating the operation of the opening mechanism.
Figure 14:
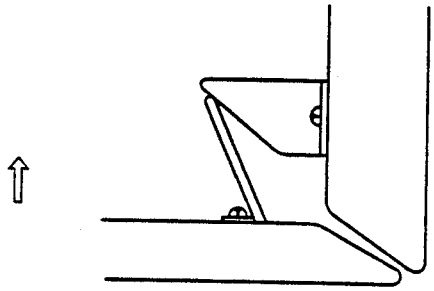
Figure 14:
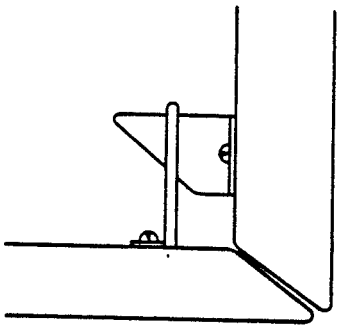

The hook 61 and the protrusion 62 thus constructed prevent the front cover 38 from being pulled and opened when the right side cassette part 34 is accommodated inside the main frame 100 and the front cover 38 is closed, because the protrusion 62 is engaged inside the hook 61 as shown in FIG. 12 and FIG. 13. Therefore, to open the front cover, the side wall 36, that is, the right side cassette part 34 must be drawn out first. Thus, it is not possible to draw out the left side cassette part 35 accommodated inside the main frame 100 first, and the right side cassette part 34 must be first drawn out to remove the jammed paper delivered from the left side cassette part 35 and returned by the intermediate rollers 33 as previously described, thereby preventing the paper from being torn. Further, the hook 61 and the protrusion 62 return to the original state without any problem if the drawn out right side cassette part 34 is first inserted in the main frame 100 or if the opened front cover 38 is first closed. That is, if the front cover 38 is already closed, the protrusion 62 fits into the hook 61 as the right side cassette part 34 is slid into the stand. On the other hand, if the right side cassette part 34 is already inserted, when the front cover 38 is closed, the left side of the shape C of the hook 61 moves along the slope **62*a* of the protrusion 62 against the tension of the spring, as sequentially shown in FIG. 14 illustration of operation a, b and c, in the leftward direction shown in the drawing, pivoting on the shaft 61*a*, till it engages with the protrusion 62 when the front cover 38** is fully closed.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

We claim:

1. A paper feeding stand on which a recording apparatus is mounted and which feeds paper to said recording apparatus comprising:

a frame;

means for mounting said recording apparatus on said frame;

a paper feeding part disposed within said frame for holding and feeding the paper to said recording apparatus;

a paper feeding roller unit which is provided at the position opposing a paper entry portion of said recording apparatus, said paper feeding roller unit feeding the paper delivered from said paper feeding part to said recording apparatus according to the rotation thereof; and moving means for making said paper feeding part and said paper feeding roller unit movable with respect to said frame in the direction parallel to the feeding direction of the paper from said paper feeding part.

2. A paper stand as set forth in claim 1, further comprising:

a reversal rotation means for reversing the rotation of said paper feeding roller unit when paper is jammed in the roller unit between the recording apparatus and the paper feeding stand.

3. A paper feeding stand as set forth in claim 1, further comprising:

a second paper feeding part installed at the position opposing said paper feeding part inside said frame.

4. A paper feeding stand as set forth in claim 3, wherein said paper feeding roller unit comprises:

two rotation shafts provided in parallel along the direction intersecting the direction of the paper feeding path;

two sets of plural rollers, which are attached on each said rotation shaft, with close space therebetween; and a paper guide inserted in the space between said rotation shafts where said rollers are not installed.

5. A paper feeding stand as set forth in claim 4, wherein the thickness of said paper guide is larger than the clearance between the opposing rollers.

6. A paper feeding stand as set forth in claim 3, wherein said paper feeding roller unit comprises:

two rotation shafts provided in parallel along the direction intersecting the direction of the paper feeding path;

two sets of plural rollers, which are attached on each said rotation shaft, press contacting with the respective opposing rollers; and a paper guide inserted in the space between said rotation shafts where said rollers are not installed.

7. A paper stand as set forth in claim 1, further comprising, means for sensing paper jammed between the recording apparatus and the paper feeding stand;

reversal rotation means responsive to said sensing means for reversing the rotation of said paper feeding roller unit when the paper is jammed.

8. A is paper feeding stand on which a recording apparatus is mounted and which feeds paper to said recording apparatus comprising:

a frame having a space inside thereof and on which said recording apparatus is mounted;

a first paper feeding part which is mounted inside said frame with a portion protruding outside and which holds and feeds the paper to said recording apparatus;

a second paper feeding part which is provided inside said frame and holds and feeds the paper to said recording apparatus;

a paper feeding roller unit which is provided at the position opposing the paper entry of said recording apparatus and feeds the paper delivered from said first and second paper feeding parts to said recording apparatus according to the rotation thereof;

a first moving means for making said first paper feeding part and said paper feeding roller unit movable with respect to said frame in the direction intersecting the axial direction of the rollers; and a second moving means for making said second paper feeding part and a support member supporting said second paper feeding part movable with respect to said frame in the direction intersecting the direction of said paper feeding path.

9. A paper feeding stand as set forth in claim 8, further comprising:

a reversal rotation means for reversing the rotation of said paper feeding roller unit.

10. A paper feeding stand as set forth in claim 8, wherein said second moving means is movable after said first moving means has been moved.

11. A paper feeding stand as set forth in claim 8, wherein said frame comprises a cylindrically shaped pin having a portion narrower in diameter, which is provided on the bottom plate thereof.

12. A paper feeding stand as set forth in claim 11, wherein said pin is tapered from its tip side and base side respectively.

13. A paper feeding stand as set forth in claim 11, wherein said support member at one end has a notch which engages with said portion narrower in diameter.

14. A paper feeding stand as set forth in claim 8, wherein said second paper feeding part comprises;

a paper cassette for containing and holding the paper;

a take-up roller for taking up the uppermost paper in said paper cassette;

a chassis which has a driving unit for rotating said take-up roller and supports said take-up roller rotatably;

a bottom plate attached to said chassis having an oval hole which is provided approximately in the center of the widthwise direction intersecting the direction of the paper feeding path and which extends in the direction intersecting the direction of the paper feeding path, and through holes which is provided near the sides along the paper feeding path, having a diameter sufficiently larger than that of the screws that fix said bottom plate to said support member, wherein said bottom plate is mounted and fixed to said support member with the screws inserted into said through holes and the screw or pin inserted into said oval hole.

15. A paper feeding stand as set forth in claim 8, wherein said paper feeding roller unit comprises:

two rotation shafts provided in parallel along the direction intersecting the direction of the paper feeding path;

two sets of plural rollers, which are installed on each said rotation shaft, with close space therebetween; and a paper guide inserted in the space between said rotation shafts where said rollers and not installed.

16. A paper feeding stand as set forth in claim 15, wherein the thickness of said paper guide is larger than the clearance between the opposing rollers.

17. A paper feeding stand as set forth in claim 8, wherein said paper feeding roller unit comprises:

two rotation shafts provided in parallel along the direction intersecting the direction of the paper feeding path;

two sets of plural rollers, which are installed on each said rotation shaft, press contacting with the respective opposing rollers; and a paper guide inserted in the space between said rotation shafts where said rollers are not installed.

18. A paper feeding stand on which a recording apparatus is mounted and which feeds paper to said recording apparatus comprising:

a frame having a pair of first support rods provided near the sides along either one of the widthwise directions of the bottom portion of said recording apparatus and arranged in the positions opposing and in parallel with each other in the other widthwise direction, a plurality of columns, provided near the each end of said first support rods, that support these rods and a pair of second support rods provided in parallel with said first support rods across said columns and having approximately the same size as that of said first support rods; and a paper feeding part which is installed in the space between said first and second support rods and holds and feeds the paper to said recording apparatus.

* * * * *